US005386755A

United States Patent [19]

Schneider et al.

[11] Patent Number: 5,386,755

[45] Date of Patent: Feb. 7, 1995

[54] DEVICE TO ENSURE UNIFORM SLICING OF BREAD

[76] Inventors: Raymond J. Schneider; Nicolie D. Schneider, both of 4344 SW. 3rd Ave., Cape Coral, Fla. 33914

[21] Appl. No.: 55,380

[22] Filed: May 3, 1993

[51] Int. Cl.[6] ..... B26D 3/16

[52] U.S. Cl. ..... 83/762; 30/289

[58] Field of Search ..... 30/114, 289; 83/761, 83/762; 269/287, 288, 293

[56] References Cited

U.S. PATENT DOCUMENTS

| | | | |
|---|---|---|---|
| 1,072,450 | 9/1913 | Hamblin | 83/762 |
| 1,703,154 | 2/1929 | Lanzkron | 83/762 |
| 1,867,993 | 7/1932 | Tuttle | 83/762 |
| 4,890,525 | 1/1990 | Bilbao | 83/761 X |

*Primary Examiner*—Douglas D. Watts
*Attorney, Agent, or Firm*—Alfred E. Wilson

[57] ABSTRACT

A device that will allow individuals to uniformly slice bread. The unit will hold a loaf of bread and allow it to be sliced by assuring the positioning of the bread knife. This will be provided for by having corresponding sets of slots located on opposing sides of the device with the loaf of bread held between these slots by a fluidly variable closing mechanism. By engaging the knife in corresponding slots the individual will be allowed to slice the loaf of bread while limiting the range of lateral motion of the knife. This will assure the user of uniform cuts to the loaf of bread whether those slices are made at a ninety degree angle to the sides or at some other angle to the sides. Once a slice is completed the knife will be removed from the device and moved to an adjacent set of corresponding slots. The process will then be repeated over and over until the desired number of slices of bread have been cut. The cut slices of bread will then be removed from the device. If all of the sets of slots have been utilized and additional slices of bread are required and a portion of the loaf remains unsliced, the loaf would be advanced to align the loaf with the slots and the slicing process would be repeated. The device would have insert dividers which would be used to hold bagels or croissants for uniform cutting.

5 Claims, 6 Drawing Sheets

DEVICE TO ENSURE UNIFORM SLICING OF BREAD

BACKGROUND OF THE INVENTION

1. Field of the Invention

This invention relates to a device to allow individuals to slice bakery items such as loaves of bread in a uniform and consistent manner. The whole loaves of bread can be those bought commercially, which have not been sliced, or can be of the various homemade kinds. These loaves of bread can be of various sizes and shapes and made of a variety of ingredients. Loaves which are of a size or proportion that will not fit in the device would be sectioned by making at least one slice of the loaf lengthwise before insertion into the device. Once the loaf, or a portion of a loaf, had been inserted into the device, a series of cuts would be made to the loaf by the user. These cuts would be made by the user with a ordinary bread knife and utilizing the guides to ensure uniform cuts to the loaf of bread. The loaf of bread thus could be cut as it is needed for consumption or the entire loaf could be sliced in one session. If the bread is cut as it is consumed, the uncut section of the loaf of bread would remain fresh longer. By utilizing two of the provided inserts bagels, croissant or other such bakery items could be sectioned in a uniform manner.

2. Brief Description of the Prior Art

Generally bread is sliced by individuals by holding the loaf of bread with one hand and slicing it with a knife held in the other hand. This method has been less efficient than desired. The primary disadvantages of this method has been the lack of control over alignment and movement of the knife blade. The slicing of a loaf of bread requires a series of cuts with the desire of a uniform alignment of the cuts and a consistent thickness of the resulting slices. This lack of control over the movement of the knife results in slices that are not uniformly aligned with the loaf. It also results in individual slices which are not of a consistent thickness.

In the old days a large percentage of bread consumed was homemade. There were a great many bakery shops that baked bread on a daily basis. The individuals would slice the bread, either homemade or bought from the commercial bakery, as it was consumed. This resulted in bread staying fresh longer. This was accomplished by the hard outer portion, commonly referred to as the crust, that was created during the cooking process. This outer portion acts to both prevent absorption of moisture and prevent the loss of moisture from the interior of the loaf.

Today the majority of bread is commercially manufactured and distributed. This bread is almost always distributed in loaves which have been cut into individual slices. In order to insure freshness bread producers employ preservatives, which are added to the bread before baking. Many people today are returning to natural foods, and therefore are attempting to eliminate many of the chemicals that are in processed foods. Many people have come to believe that the chemicals that have made their lives more convenient also have the potential to be harmful over long periods of consumption.

The making of bread at home is increasing as is evident by the sales of bread making machines. These machines allow individuals to make bread in a convenient fashion. They simply place the ingredients in the machine and the machine performs the various time consuming tasks involved in bread making. The machine mixes the ingredients and allow for the rising process to occur. Then the machine kneads the dough and allow for any required subsequent rising processes. Some machines even bake the dough in the same machine. Other of these machines require the user to transfer the dough to the kitchen oven for cooking.

Whether the individual bakes the loaf of bread at home or purchases a whole unsliced loaf from a bakery, it still must be sliced. Your applicants are not aware of any prior invention that allows for the uniform slicing of bread by individuals.

In the art we find various devices which have attempted to allow uniform slicing of the loaves of bread by individuals.

The bread slicing and storage container shown in U.S. Pat. No. 4,085,642, granted to Birmingham on Apr. 25, 1978. This device shows a apparatus incorporating a plurality of slicing guides located on opposing sides. These sides are adjustable one to the other. The opposing slots being utilized to align the blade of a knife for the slicing of bread.

The bread slicing guide disclosed in U.S. Pat. No. 253,744 issued Dec. 25, 1979 to Davis shows an apparatus incorporating a plurality of slicing guides located on opposing sides. The opposing slots being utilized to align the blade of a knife for the slicing of bread.

The board illustrated in U.S. Pat. No. 2,398,192 issued Apr. 9, 1946 to Scheminger shows a device having a plurality of slots with the device being collapsible for storage.

The device shown in U.S. Pat. No. 4,964,323, issued Oct. 23, 1990 to Fortney shows a apparatus incorporating a plurality of slicing guides located on opposing sides. These sides are adjustable one to the other. The opposing slots being utilized to align the blade of a knife for the slicing of bread.

While these devices have attempted to provide for a safe and convenient method of slicing bread they do not make provisions for the angled slicing of bread or a fluid variable adjustment of the side members or the facility of allowing bagels or croissants to be sliced. Further they do not make provisions to allow the blade of the knife extend beneath the bakery item being sliced thus assuring a complete severing of the slice from the remainder of the item. For these reasons and others they are not as efficient as desired.

OBJECTS AND ADVANTAGES OF THE INVENTION

The primary object of the invention is to provide individuals with the ability to hand slice loaves of bread and other baked goods in a consistent fashion that is simple and easy to use. Other objects and advantages of the invention include;

(a) provide the user with a safe method of slicing bread that will reduce the danger of cutting oneself currently associated with slicing bread.

(b) allow the individual to slice bread that will have a consistent alignment with the loaf of bread.

(c) allow the individual to slice bread that will have a consistent thickness throughout the individual slices.

(d) permit the user to select from a range of widths for the series of slices.

(e) permit the user to select from a range of angles for the series of slices as is desirable for slicing many breads such as French bread.

(f) provide the user with the flexibility to conveniently slice only the bread that will be consumed at that particular time. Thus the remainder of the loaf of bread will remain fresh longer as less of the interior of the loaf will be exposed.

(g) allow for the versatility to slice bagels, croissants and other such baked goods in a consistent fashion. This will be provided for by having a set of dividers, or inserts, that will hold each individual food item securely aligned.

(h) provide for a device that will be of simple construction and therefore be durable.

(i) provide for a device that will be easy to maintain and to clean.

(j) allow for one side of the device to be adjustable to the corresponding side of the invention while maintaining proper alignment. This will allow the individual to ad;just the sides of the device so as to have the corresponding sides of the device in contact with the opposing sides of the loaf of bread. This will prevent the loaf of bread from having the opportunity to lose the proper alignment with the device during use.

(k) allow for recessed slots in the base of the device that would correspond to the sets of slots of the device. This would allow for the cutting edge of the knife to extend beyond the limits of the loaf of bread. This will ensure that each and every cut to the loaf of bread will result in a totally severed slice of bread.

Other objects, features and advantages of the present invention will become apparent to those skilled in the art from the detailed description which follows. It should be understood, however, that the detailed description, while indicating preferred embodiment, is given as an example and not a limitation. Many changes and modifications to the invention are possible without departing from the spirit of the invention, and all such modifications are included.

BRIEF DESCRIPTION OF THE DRAWINGS

Referring now to the drawings were like reference numerals refer to like parts throughout the various views.

Figure 1:
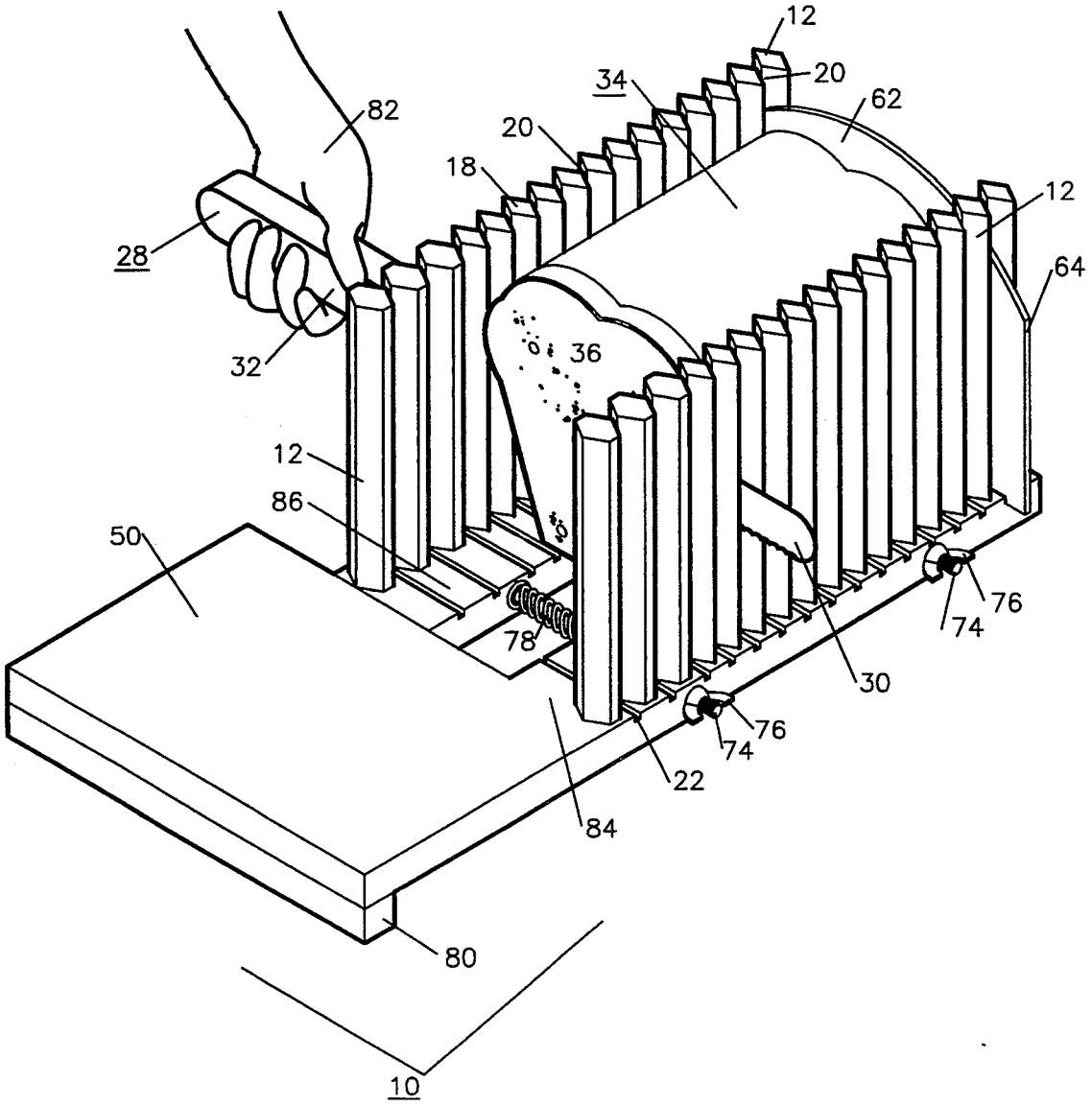
FIG. 1 is a perspective view of the invention shown in use.

| REFERENCE NUMERALS IN DRAWINGS | |
|---|---|
| 10 Bread slicing box | 12 Side member |
| 14 Base | 16 Sectioned base |
| 18 Extension member | 20 Side slot |
| 22 Base slot | 24 Angled extension member |

-continued

| REFERENCE NUMERALS IN DRAWINGS | |
|---|---|
| 26 Angled slot | 28 Bread knife |
| 30 Blade | 32 Handle |
| 34 Loaf of bread | 36 Slice of bread |
| 38 Bagel | 40 Curved enclosure |
| 42 Base | 44 Angled side |
| 46 Slot | 48 Base slot |
| 50 Extended cutting board | 52 Curved extension member |
| 54 Edge end of extension | 56 Shape of extension |
| 58 Shape of extension | 60 Shape of extension |
| 62 Insert | 64 End of insert |
| 66 End of insert | 68 Insert protrusion |
| 70 Hole | 72 End of insert |
| 74 Bolt | 76 Wing nut |
| 78 Spring | 80 Support leg |
| 82 Hand | 84 Base |
| 86 Base | 88 Angled base slot |
| 90 Angled member | |

SUMMARY OF THE INVENTION

This invention will allow for the continued expansion of the back to basics lifestyle that so many Americans have undertaken. It will permit individuals to utilize the ever expanding use of dough making machines and bread making machines, This invention will eliminate the last obstacle that exists to the widespread acceptance of homemade bread. This obstacle being the lack of a method to consistently and economically slice the loaves of bread made, The invention is versatile yet simple in concept. Its use will be safe and efficient and require little or no instruction.

DESCRIPTION OF THE PREFERRED EMBODIMENT

Referring now to FIG. 1, a bread slicing box 10 is shown with a base 84, a base 86 and two opposing side members 12. Each side member 12 extends a predetermine distance from the respective base 84 or 86 and raising a distance .greater than the height of a standard loaf of bread. Side members 12 further including a plurality of extension members 18 which extend relatively vertically from the respective base 84 or 86. A series of side slots 20 are created between each adjacent sets of extension members 18. Further, a set of aligned base slots 22 are formed in base 84 and base 86. Base slots 22 are aligned with corresponding sets of side slots 20 located on the two opposing side members 12. Base slots 22 will allow the blade to extend below the surface supporting the baked goods so as to assure the complete severing of the cut. The entire unit is raised on a plurality of support legs 80. Shown is a bread knife 28 comprised of handle 32 and blade 30. Bread knife 28 is shown inserted in bread slicing box 10 utilizing two opposing side slots 20. Bread knife 28 held by an individual using hand 82 is further shown engaging and slicing a loaf of bread 34. A partially cut slice of bread 36 is being formed by this action. Base 84 and base 86 are attached and held detached one to the other by bolts 74, springs 78 and wing nuts 76. Bread slicing box 10 therefore is formed of base 84 and base 86 which are adjustable laterally one to the other by adjusting wing nuts 76. This adjustment action will allow the individual to close side members 12 one to the other so as to engage and hold secure loaf of bread 34.

Shown inserted behind loaf of bread 34 is an insert 62 having the purpose of preventing loaf of bread 34 from moving laterally within the device. In this embodiment the insert is relatively flat in design and the opposing ends that extend beyond side members 12 have an end of insert 64 which is straight.

Side slots 20 generally have a uniform predetermine spacing one to the next. Side slots 20 at one end of the device have a predetermined number of their members spaced at a slightly greater distance apart. This is to provide for the uniform slice of bread so that the resulting slices will have a great thickness than the slices formed uses the remaining slots.

Extending beyond the limits created by the two parallel side members 12 is an extended cutting board 50 attached to base 84. This will afford the individual user the freedom to have additional work space that is level with base 84 and base 86 of bread slicing box 10.

Figure 2:
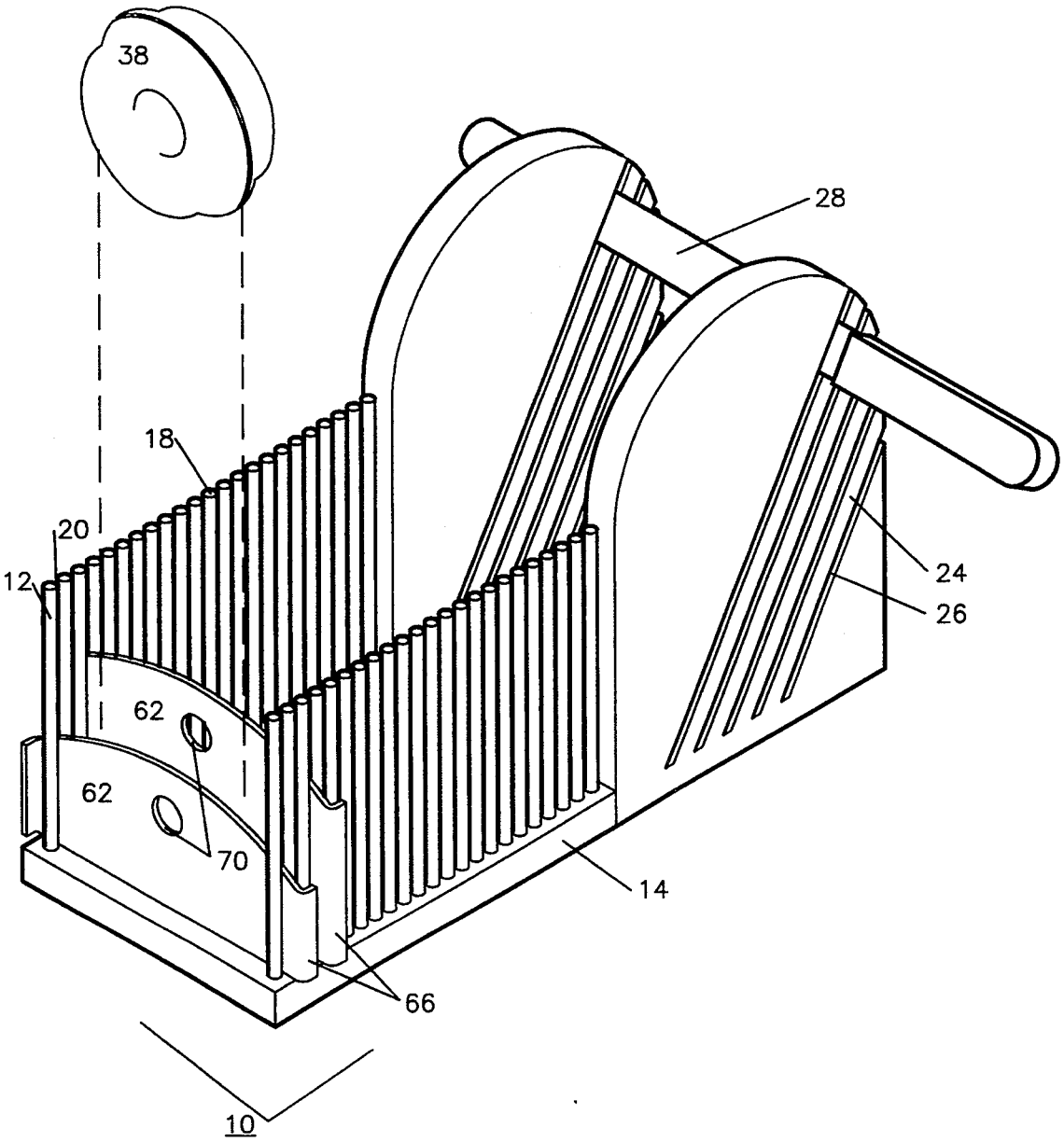
FIG. 2 shows a perspective view of an alternate embodiment of the invention.

FIG. 2 show an alternate embodiment of the invention illustrating a bread slicing box 10 comprised of base 14 and two corresponding side members 12. Each of the side members has a plurality of extension members 18 and a plurality of angled extension members 24. Located between, and formed by, each adjacent set of extension members 18 is a side slot 20. Located between, and formed by, each adjacent set of angled extension members 24 is a angled slot 26. Slots 20 or slots 26 when used in opposing pairs will allow the insertion and guiding of a bread knife 28 to slice baked goods. Shown inserted in a set of these opposing angled slots 26 is bread knife 28. When used in these slots the resulting cut to the baked goods will have an angled cut.

Also shown inserted into the device utilizing non adjacent opposing sets of side slots 20 are two inserts 62 which act to form a five sided receptacle of predetermined proportions. Insert 62 has two opposing ends of insert 66. End of insert 66 are each curved in shape to the rest of the insert. This is to prevent inserts 62 from slipping out of side slots 20. Each insert 82 also has at least one hole 70 to allow ease of insertion and ease of removal from side slots 20. Into the created compartment will be inserted a baked good such as a bagel 38. The utilization of non adjacent sets of side slots 20 places at least one set of opposing side slots 20 between the two inserts 62. This will allow the use of a set of opposing side slots 20 to be utilized by using a knife to slice bagel 38 held securely between inserts 62. Thus bagels can be consistently sliced by the individual user.

Figure 3:
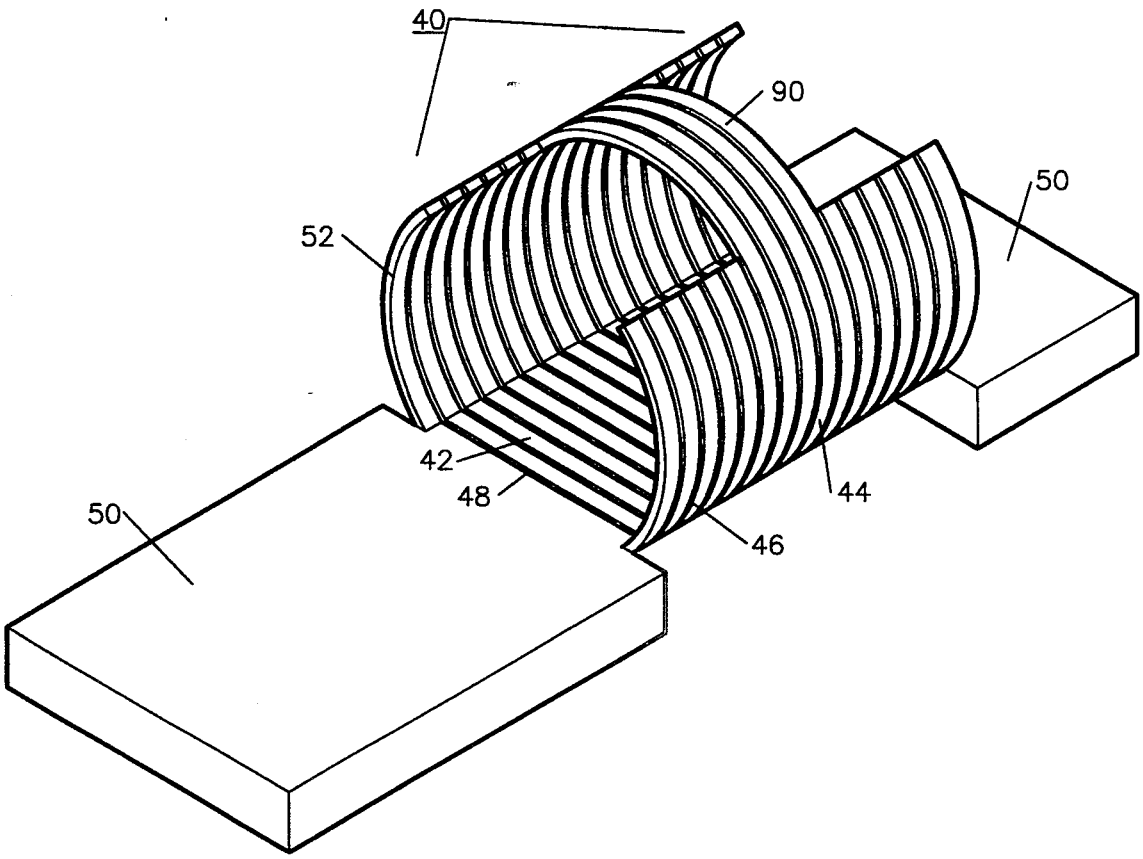
FIG. 3 shows a perspective view of another embodiment of the invention.

FIG. 3 shows another embodiment of the invention in the form of a curved enclosure 40. Formed of base 42, two angled sides 44 and extended cutting boards 50. Angles sides 44 are comprised of a plurality of opposing curved extension members 52 and a plurality angled members 90. Located between, and formed by, each adjacent set of curved extension members 52 is a slot 46. Located between and formed by each set of adjacent angled members 90 is a slot 46. Formed by each angled member 90 and adjacent curved extension member 52 is a slot 46. Aligned with slots 46 and connecting opposing sets of slots 46 are base slots 48 which have the purpose of allow the blade of the knife to extend below the baked goods being sliced to ensure a complete severing of the portion of the baked good being sliced from the remaining part. Extended cutting boards 50 allow the individual user to have a sufficient work area that is level with base 42.

Figure 4:
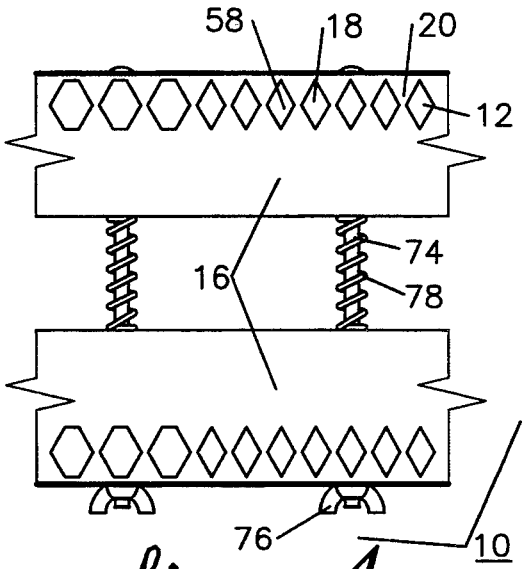
FIG. 4 shows a top view of a cutaway section of the invention.
Figure 5:
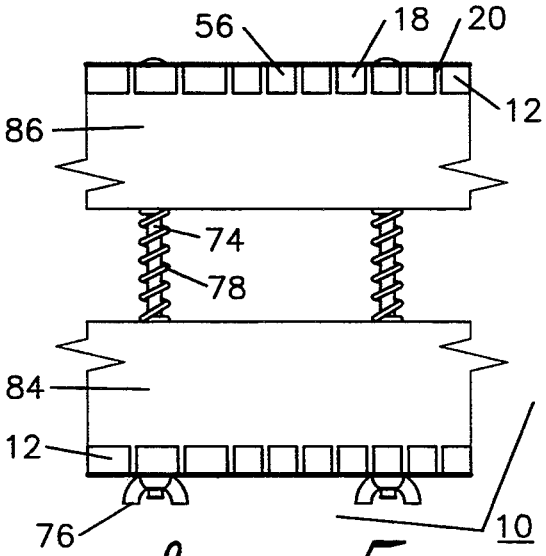
FIG. 5 shows a top view of a cutaway section of an alternate embodiment of the invention.

FIGS. 4 and 5 illustrate two possible embodiments of the shape of the extension members 18. These views are overhead plan views showing a cutaway view of bread slicing box 10. Also shown are side members 12, a plurality of extension members 18, a plurality of side slots 20, base 84, base 86, bolt 74, spring 78 and wing nut 76.

Referring now to FIG. 4 which shows extension members 18 with the shape of extension 58 as used in FIG. 1. These slots will allow the user selectable placement of the blade of the knife at variable angles to side members 12. The blade would be inserted into one of side slots 20 on one of side members 12 and the desired side slot 20 on opposing side member 12.

FIG. 5 shows a generally rectangular shape of extension 56 on extension members 18. This shape will restrict the user to utilize corresponding sets of side slots 20 which will result in a relative straight cut to the baked goods being sliced. This is due to the fact that the knife will be limited to extending generally perpendicular to side members 12.

Figure 6:
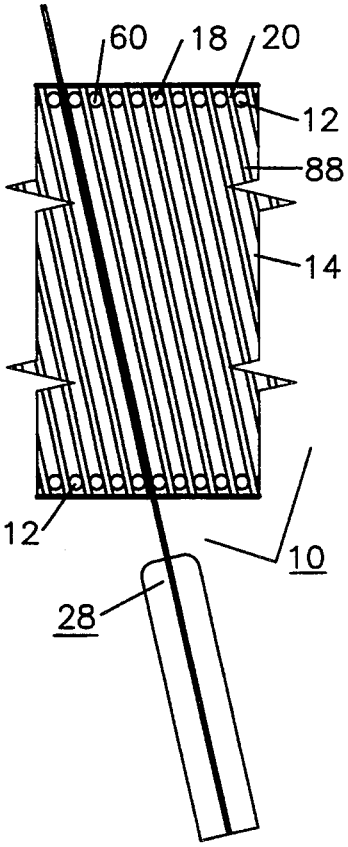
FIG. 6 shows a top view of a cutaway section of another embodiment of the invention.

FIG. 6 shows a third possible embodiment of the shape of the extension members 18. Shown is a overhead plan view showing a cutaway view of bread slicing box 10. Shown are base 14, side members 12, a plurality of extension members 18, a plurality of side slots 20 and a plurality of angled base slots 88. A generally round shape of extension 60 on extension members 18 is also illustrated. This shape also will allow the knife to be inserted in various side slots 20 on opposing side members 12. Thus the individual user will be able to select the desired angle of cutting of the baked goods being sliced. Shown inserted in non corresponding side slots 20 is knife 28 having blade 30 and handle 32.

Figure 7:
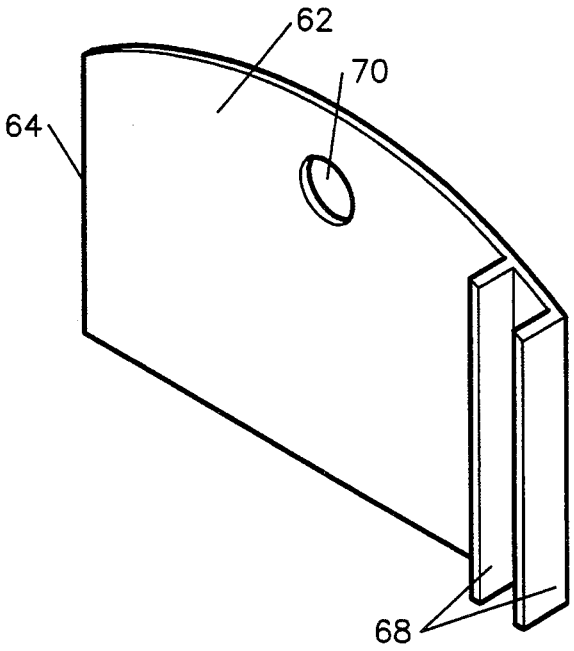
FIG. 7 shows a perspective view of an insert.

FIG. 7 shows a perspective view of an insert 62 having two opposing ends, one end of insert 64 is straight, relative to the body of the insert 62 and an opposing end of insert, 72 which has two insert protrusions 68 which will be utilized in such a manner so as to have one extension member between them. This will prevent the insert 62 from slipping once inserted in two slots on opposing side members. Also shown is a hole 70 which will allow ease of insertion and ease of removal of the insert 62 in the slots of the device.

Figure 8:
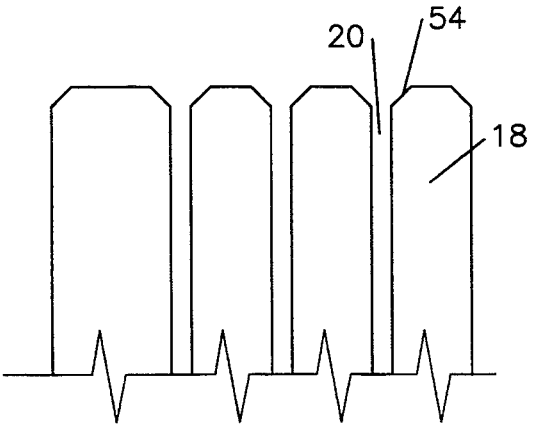
FIG. 8 shows a front view of a cutaway section of the invention.
Figure 9:
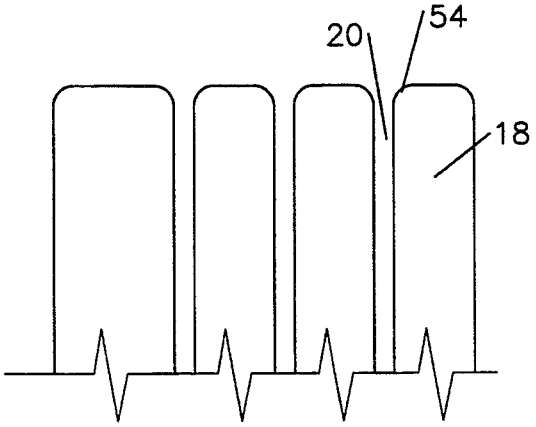
FIG. 9 shows a front view of a cutaway section of the invention.

FIG. 8 and FIG. 9 show plan cutaway views of alternate embodiments of the top of extension members 18. These embodiments will allow easier insertion of the knife blade while minimizing the concern of cutting the top of extension members 18.

FIG. 8 shows the edge end of extension 54 with angled cuts removed on each side corresponding with a side slot 20.

FIG. 9 shows the edge end of extension 54 with rounded ends.

Figure 10:
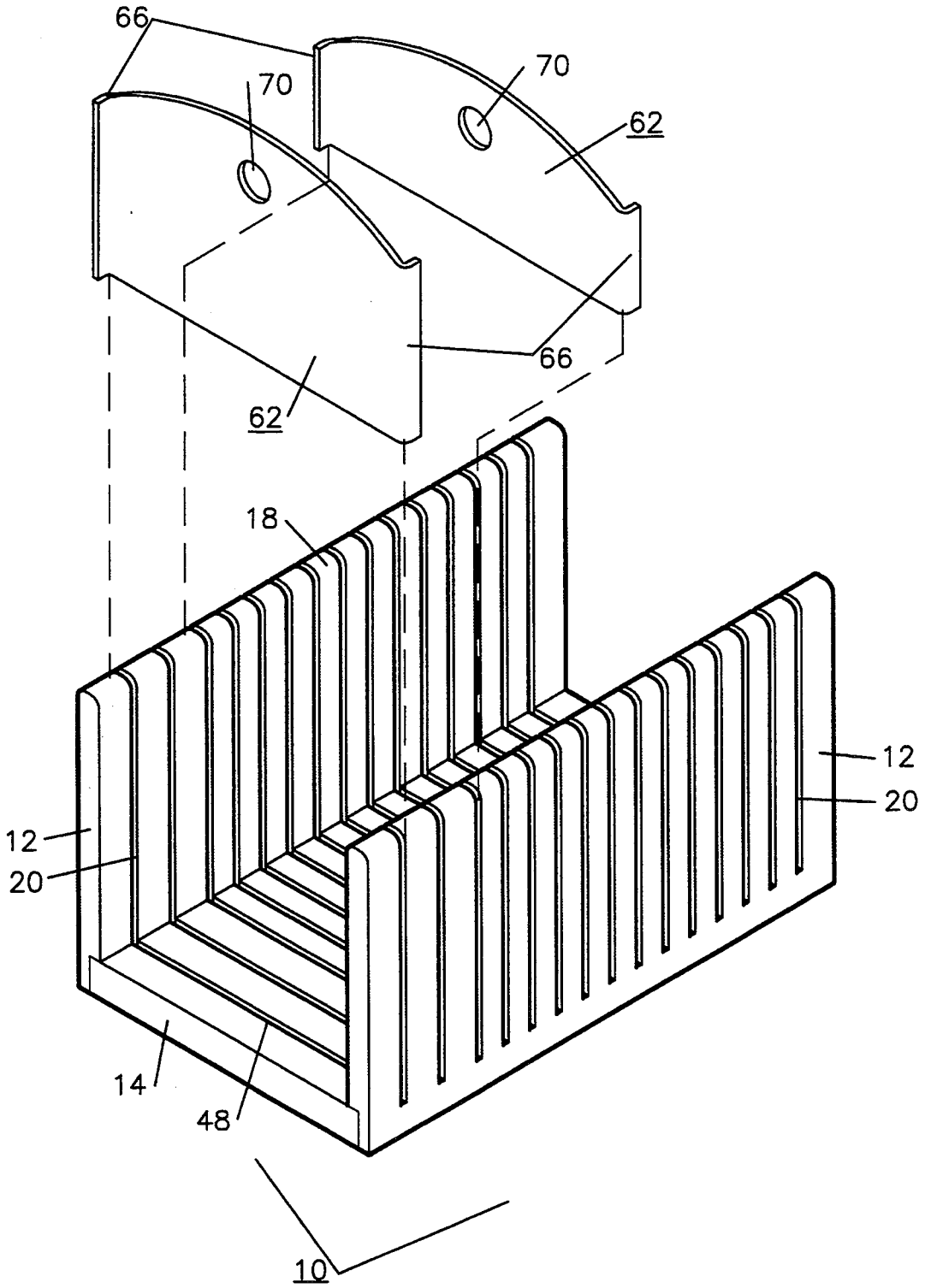
FIG. 10 shows a perspective view of a another embodiment of the invention.

FIG. 10 shows a perspective view of bread slicing box 10 having a base 14 and opposing side members 12 extending generally perpendicular to base 14. Each side member 12 has incorporated in its design a plurality of extension members 18. Formed by each adjacent set of extension members 18 is a side slot 20. Corresponding with each opposing set of side slots 20 is base slot 48 having the purpose disclosed previously. Also shown are inserts 62 having holes 70 for ease of insertion and removal. Inserts 62 additionally have end of inserts 66 forming a curved shaped end which prevents inserts 62 from slipping once inserted in a set of opposing side slots 20.

CONCLUSIONS AND RAMIFICATIONS OF THE INVENTION

The description above contains specifics which deal mostly with three sided devices. The invention could be constructed in a wide variety of shapes and sizes. The only limitation being that a whole, unsliced, loaf of bread must fit within the device so as to be situated between the corresponding sets of slots.

The device could have two sides, comprising a v shape, with a suspended floor attached between then. It could be of the three sided variety illustrated. It could have four sides forming a closed cylinder with slots on two opposing sides or on three sides. The possible configurations of the device are numerous. Additionally the device could have a movable insert to be positioned so as to hold the loaf of bread. This would result in three sets of aligned slots.

While a bread knife is disclosed any ordinary kitchen knife could be used including mechanical knives which have at least one blade that is powered to move relative to the handle.

Thus the scope of the invention should be determined by the claims rather than the embodiments shown.

I claim:

1. A bread slicing box for ensuring uniform slicing of bakery items comprising; a base of predetermined proportions having an upper surface, two opposing ends and two opposing sides, two opposing side members each attached to one of the two opposing sides of the base and extending vertically upward from the base, each of the side members having a plurality of extension members incorporated within their design, each extension member having a predetermined geometric shape, each adjacent set of extension members forming a side slot each side slot extending from the base upward to terminate at an open end, two side slots one on each of the two opposing side members capable of receiving insertion of a knife blade at their open ends and acting to guide the knife blade downward to slice a bakery item resting upon the upper surface of the base and positioned between the two opposing side members till contact is made with the upper surface of the base.

2. The bread slicing box defined in claim 1 further comprising a plurality of base slots formed in the upper surface of the base of the bread slicing box, each extending from one side slot to the corresponding side slot on the opposing side member, to permit the knife blade to extend below the plane formed by the upper surface of the base of the bread slicing box during use to ensure complete separation of the bakery item being sliced.

3. The bread slicing box defined in claim 1 further comprising a plurality of angled base slots formed in the upper surface of the base of the bread slicing box, each extending from one side slot to a predetermined non corresponding side slot on the opposing side member, all of the angled base slots having a relatively identical angular orientation to each of the two opposing sides of the bread slicing box, the angled base slots to provide for the knife blade to extend below the plane formed by the upper surface of the base of the bread slicing box during angular cutting matching the angular orientation of the angled base slots to ensure complete separation of the bakery item being sliced.

4. The bread slicing box defined in claim 1 wherein the base of the bread slicing box extends beyond the two opposing side members to provide for the slices of the bakery item to fall following slicing without leaving the confines of the bread slicing box.

5. The bread slicing box defined in claim 1 further comprising two different spacing of adjacent sets of the side slots to provide for selection of the width of the resulting slices.

* * * * *